US006513664B1

(12) United States Patent
Logan et al.

(10) Patent No.: US 6,513,664 B1
(45) Date of Patent: Feb. 4, 2003

(54) VIBRATING SCREEN SEPARATOR

(75) Inventors: Grady Logan, Oklahoma City, OK (US); Gary Fout, Cypress, TX (US); Roger Suter, Edmond, OK (US)

(73) Assignee: M-I, L.L.C., Houston, TX (US)

( * ) Notice: Subject to any disclaimer, the term of this patent is extended or adjusted under 35 U.S.C. 154(b) by 0 days.

(21) Appl. No.: 09/837,098

(22) Filed: Apr. 18, 2001

(51) Int. Cl.[7] ..... B07B 1/44; B07B 1/42

(52) U.S. Cl. ..... 209/367; 209/365.4; 209/366; 209/366.5

(58) Field of Search ..... 209/367, 365.4, 209/366, 366.5

(56) References Cited

U.S. PATENT DOCUMENTS 4,750,845 A 6/1988 Nabetani
4,990,130 A 2/1991 Prais
5,035,601 A 7/1991 Lin
5,427,451 A 6/1995 Schmidt
5,458,416 A 10/1995 Edwards et al.
5,655,836 A 8/1997 Preston et al.
5,896,998 A * 4/1999 Bjorklund et al. ..... 209/326
6,349,834 B1 * 2/2002 Carr et al. ..... 209/366.5

* cited by examiner

*Primary Examiner*—Donald P. Walsh
*Assistant Examiner*—Jonathan R. Miller
(74) *Attorney, Agent, or Firm*—Haynes & Boone LLP

(57) ABSTRACT

A vibrating screen separator. The vibrating screen separator may be operated in a linear or elliptical mode of operation. In the linear mode of operation, the screen separator moves along a reciprocating straight line path, and, in the elliptical mode of operation, the screen separator moves along an elliptical path.

20 Claims, 9 Drawing Sheets

VIBRATING SCREEN SEPARATOR

BACKGROUND

This invention relates generally to a screen separator, and in particular to a vibrating screen separator.

A typical screen separator consists of an elongated, box-like, rigid bed, and a screen attached to, and extending across, the bed. The bed is vibrated as the material to be separated is introduced to the screen which moves the relatively large size material along the screen and off the end of the bed and passes the liquid and/or relatively small sized material into a pan. The bed can be vibrated by pneumatic, hydraulic, or rotary vibrators, in a conventional manner.

Conventional screen separators are not capable of providing both balanced elliptical and linear motion.

The present invention is directed to overcoming one or more of the limitations of existing screen separators.

SUMMARY

According to an embodiment of the present invention, a separator for separating solids from liquids is provided that includes a frame, a screen coupled to the frame, means for moving the frame along a reciprocating linear path of travel, and means for moving the frame along an elliptical path of travel.

According to another embodiment of the invention, a method of operating a separator including a screen coupled to a frame is provided that includes injecting a fluidic material including solids and liquids onto the screen, moving the frame along a reciprocating linear path of travel in a first mode of operation, and moving the frame along an elliptical path in a second mode of operation.

According to another embodiment of the invention, a separator is provided that includes a frame, a screen coupled to the frame, an actuator for imparting reciprocating motion to the frame coupled to the frame, an actuator for imparting elliptical motion to the frame coupled to the frame, and a controller operably coupled to the actuator for imparting reciprocating motion to the frame and the actuator for imparting elliptical motion to the frame for controlling the operation of the actuator for imparting reciprocating motion to the frame and the actuator for imparting elliptical motion to the frame. The controller is programmed to operate in a first mode of operation in which the actuator for imparting reciprocating motion is operated and in a second mode of operation in which the actuator for imparting elliptical motion is operated.

The present embodiments of the invention provide a number of advantages. For example, the ability to operate in a linear or an elliptical mode of operation without physical restructuring or mechanical reconfiguration of the assembly provides an efficient, reliable, and cost-effective system for providing both modes of operation.

DESCRIPTION OF THE PREFERRED EMBODIMENTS

Figure 1A:
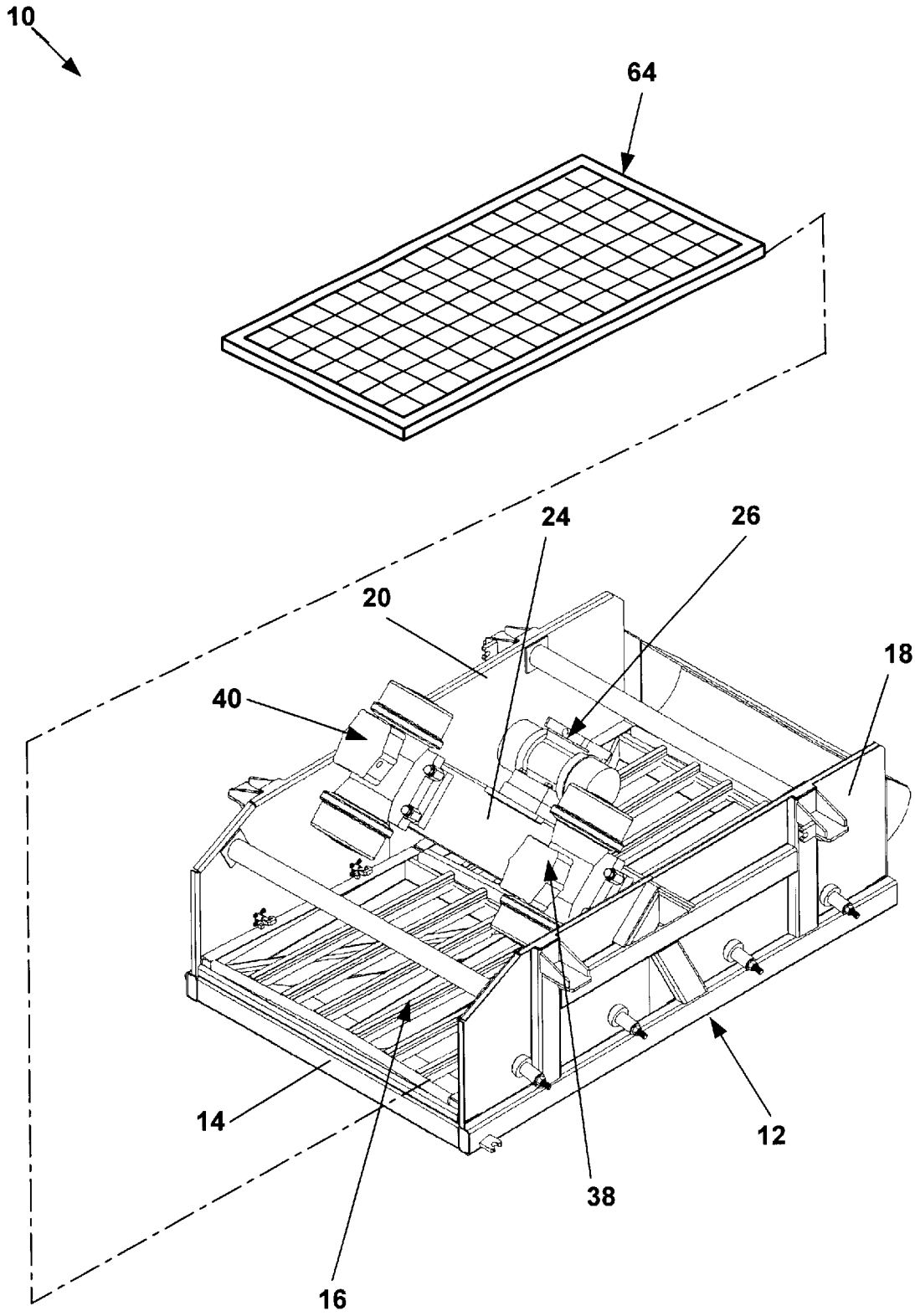
FIGS. 1*aa*, 1*ab*, 1*ac*, and 1*ad* are isometric, top, side, and front views, respectively, of an embodiment of a vibrating screen separator assembly.
Figure 1A:
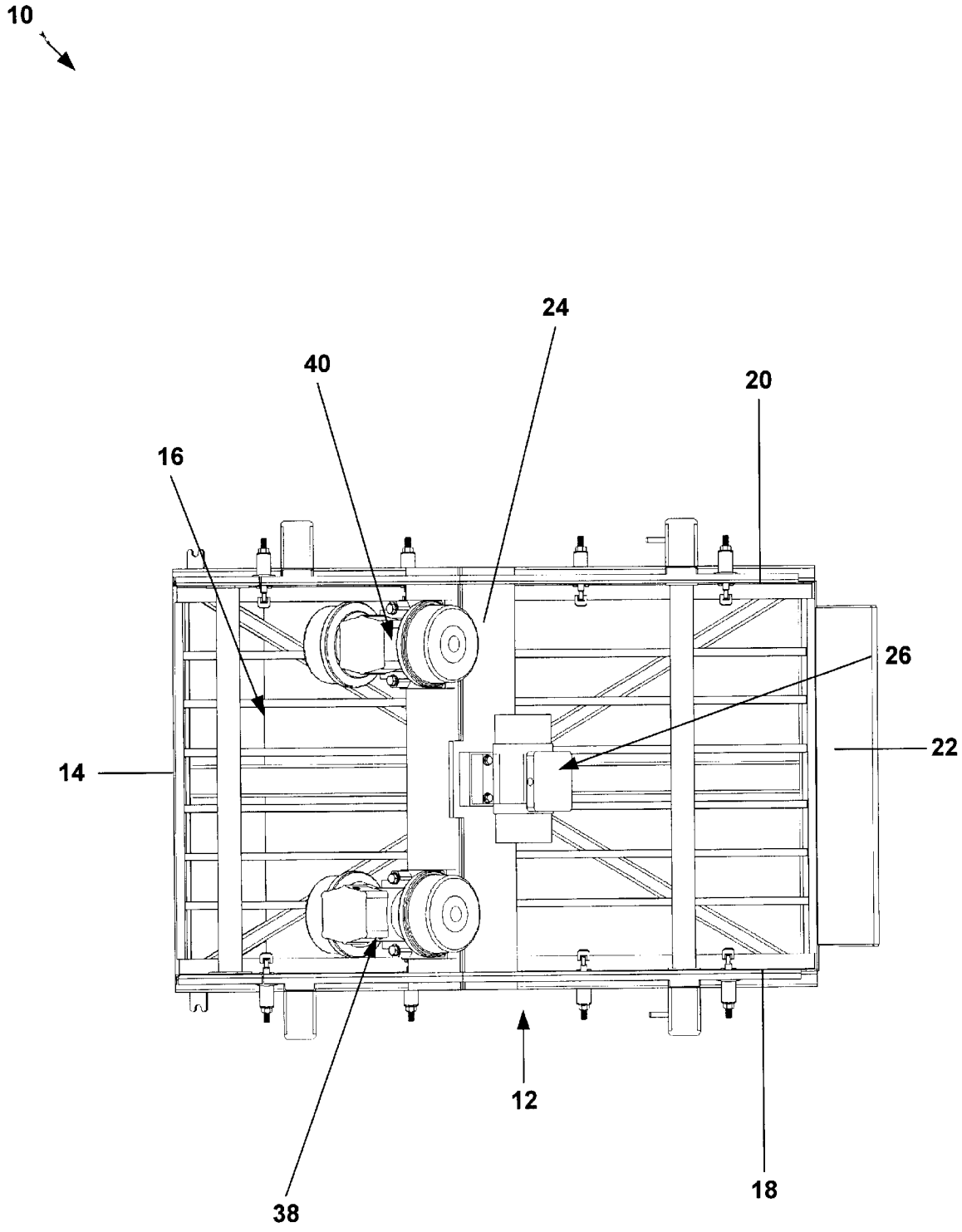
Figure 1A:
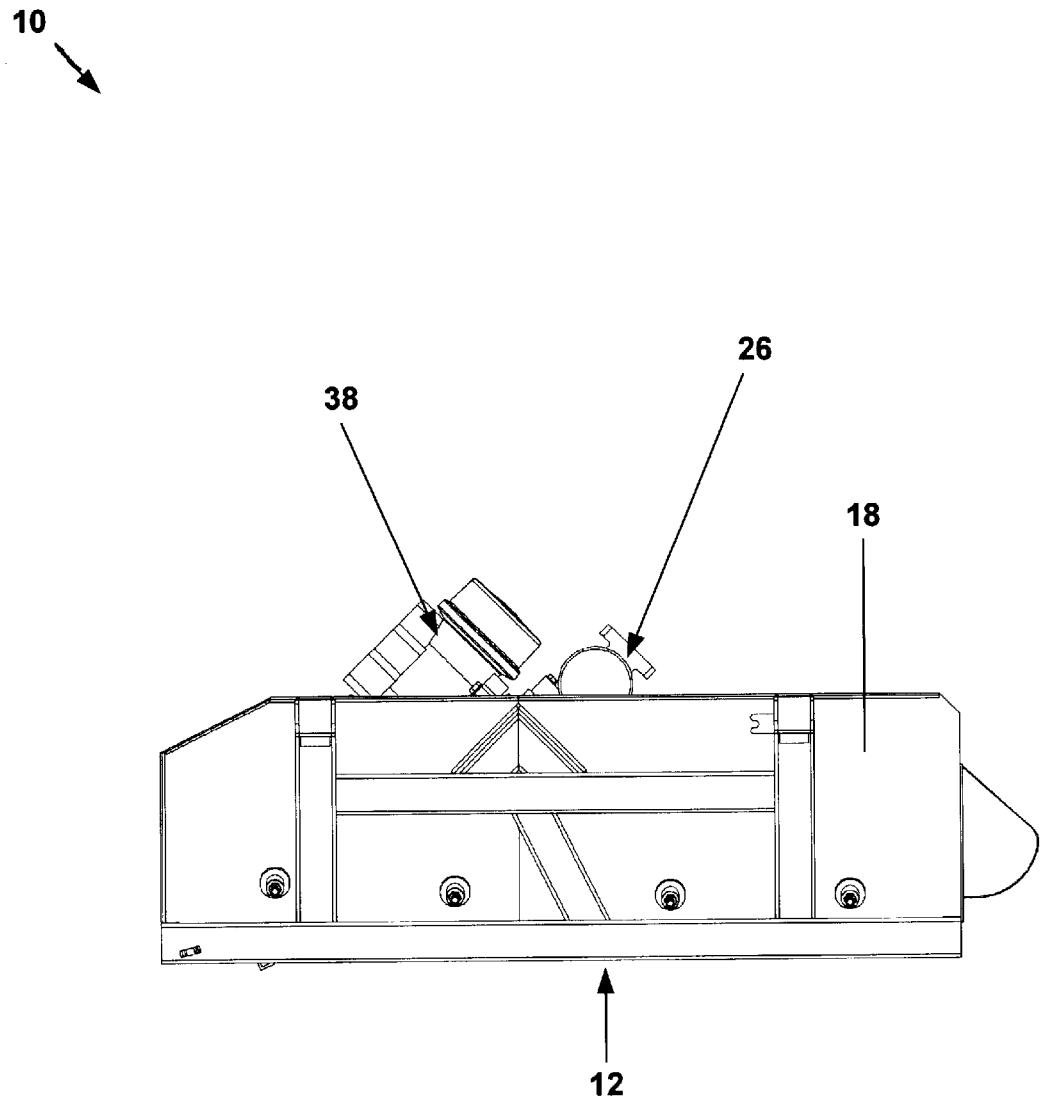
Figure 1A:
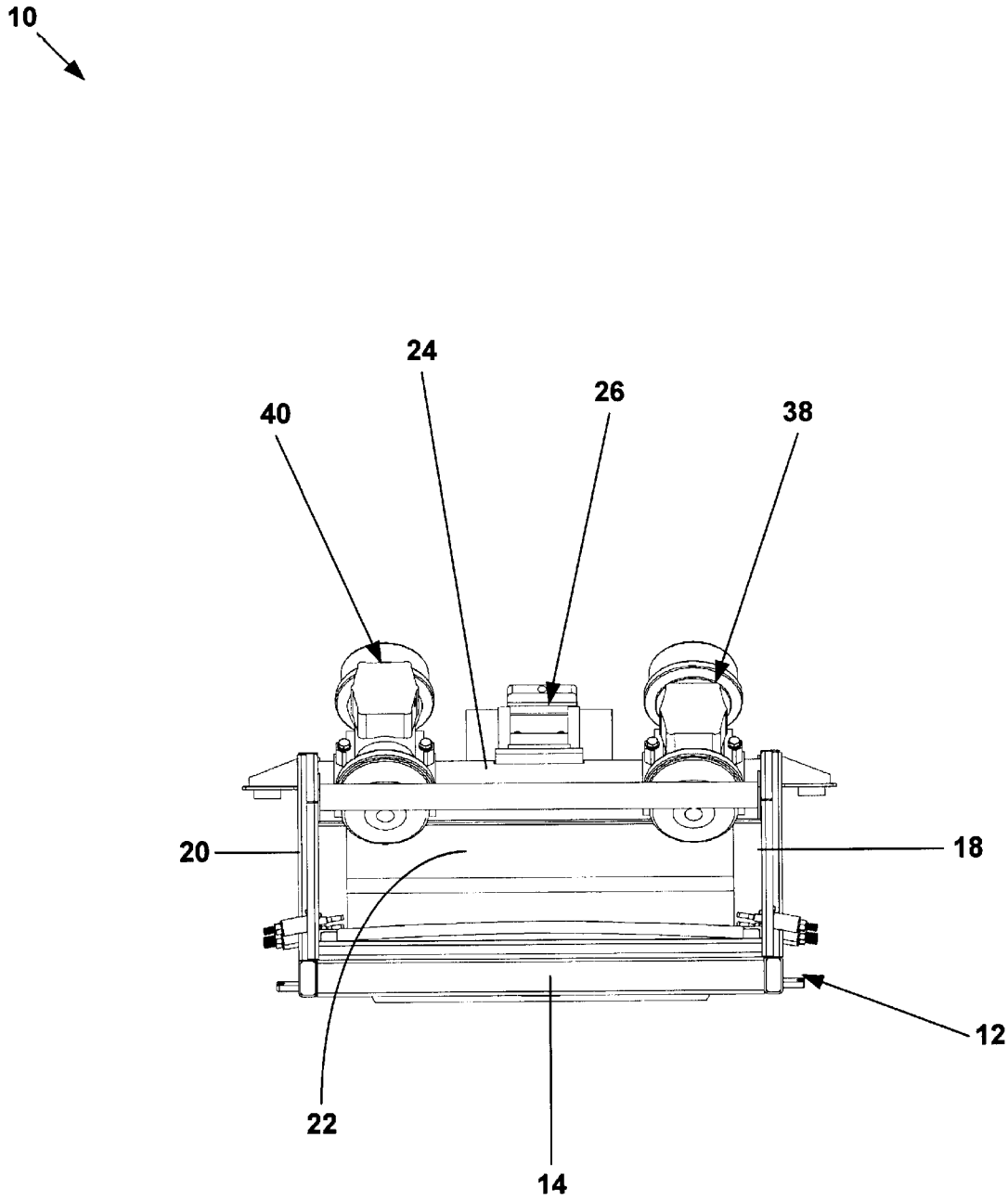
Figure 1B:
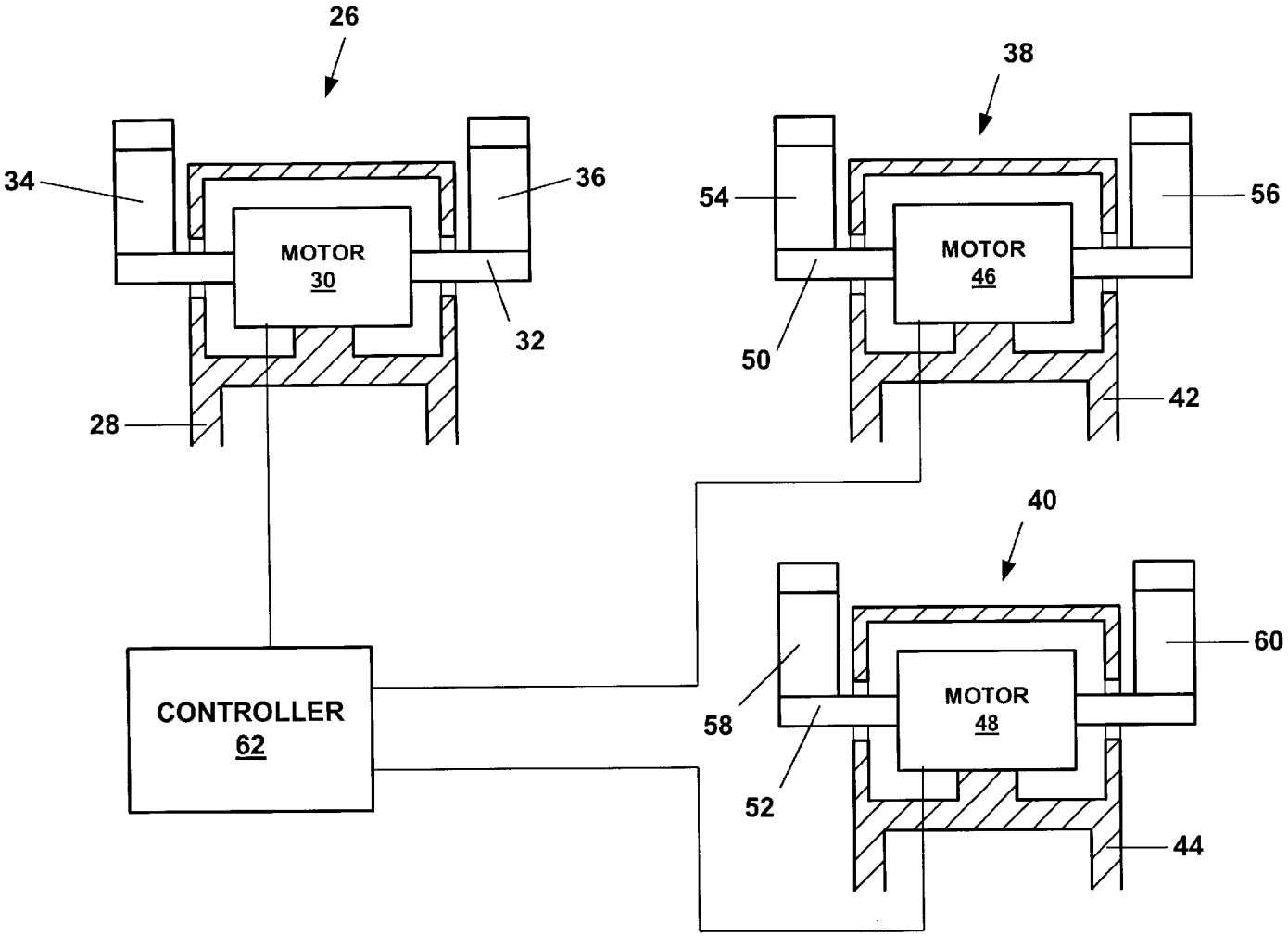
FIG. 1*b* is a fragmentary cross sectional and schematic view of the actuators and controller of the assembly of FIG. 1*a*.

Referring to FIGS. 1*aa*, 1*ab*, 1*ac*, 1*ad*, and 1*b*, the reference numeral 10 refers, in general, to a vibrating screen separator assembly that includes a frame, or bed, 12 that includes a bottom wall 14 having an opening 16, a pair of side walls, 18 and 20, an end wall 22, and a cross support member 24 coupled between the side walls. An actuator 26 for imparting motion to the frame 12 is coupled to the support member 24 that includes a housing 28 that is coupled to the support member that supports and is coupled to a rotary motor 30 having a rotary shaft 32 having opposite ends that extend out of the housing. A pair of substantially identical unbalanced weights, 34 and 36, are coupled to the opposite ends of the rotary shaft 30.

Actuators, 38 and 40, respectively, for imparting motion to the frame 12 are also coupled to the support member 24 that include housings, 42 and 44, respectively, that are coupled to the support member that support and are coupled to rotary motors, 46 and 48, respectively, having rotary shafts, 50 and 52, respectively, having opposite ends that extend out of the housings. Pairs of substantially identical unbalanced weights, 54 and 56 and 58 and 60, respectively, are coupled to the opposite ends of the rotary shafts, 50 and 52, respectively. In an exemplary embodiment, the rotary shafts, 50 and 52, are substantially parallel, the rotary shafts, 50 and 52, are perpendicular to a common plane, and the size, shape and mass of the unbalanced weights, 54, 56, 58, and 60 are substantially identical.

In an exemplary embodiment, the rotary shaft 32 is perpendicular to a different plane than the rotary shafts, 50 and 52.

The rotary motors, 30, 46 and 48, are operably coupled to a controller 62 that provides motive power and controls the operation of the rotary motors. A screen 64 is received within the frame 12 and is adapted to be rigidly coupled to the bottom wall 14 using conventional mechanical fasteners.

Figure 2:
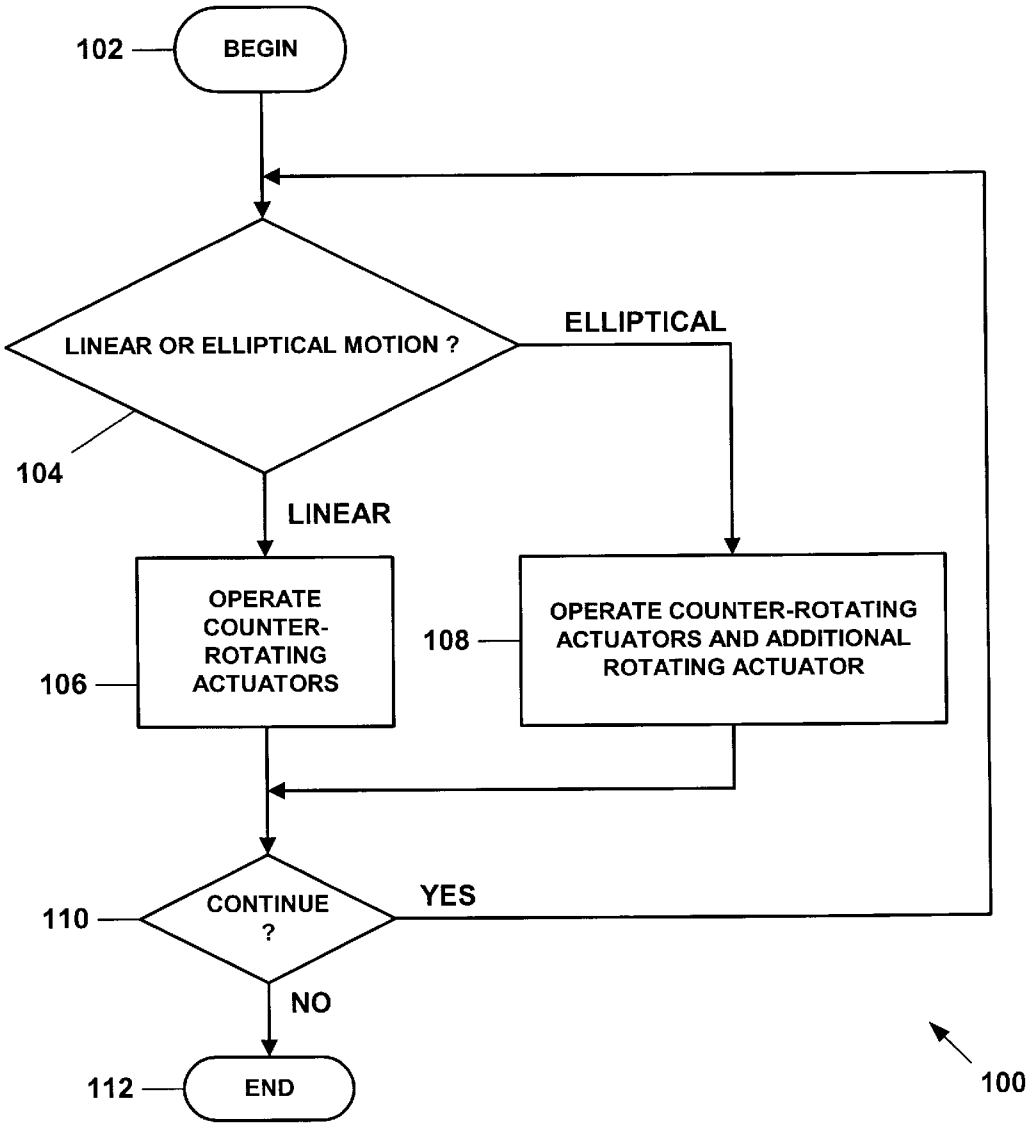
FIG. 2 is a flow chart that illustrates an embodiment of the operation of the assembly of FIGS. 1*a* and 1*b*.

During operation of the assembly 10, as illustrated in FIG. 2, the controller 62 may implement a motion control program 100 in which a user may initiate operation of the assembly in step 102. The user may then select linear or elliptical movement to be imparted to the frame 12 of the assembly 10 in step 104.

Figure 3A:
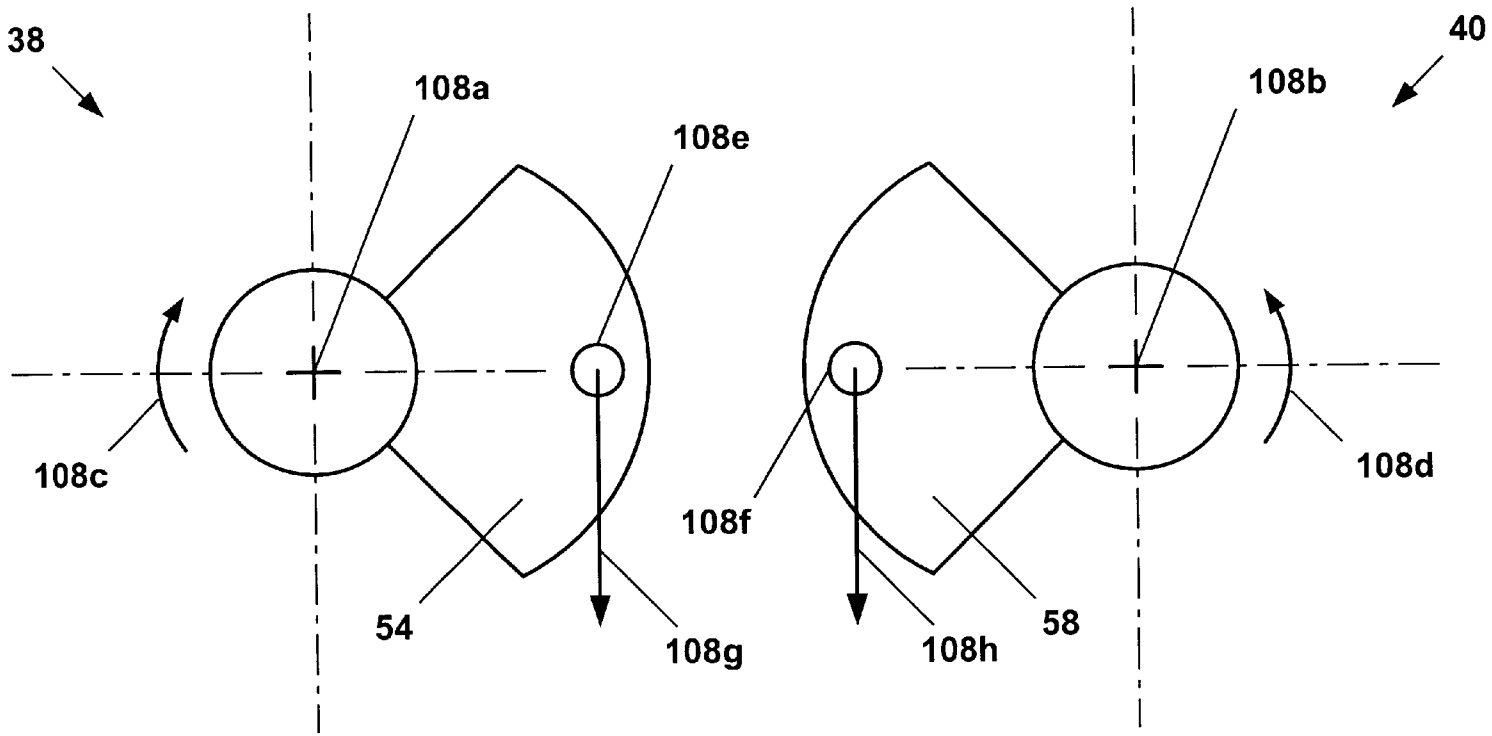
FIG. 3*a* is a side view of the operation of the counter-rotating actuators of the assembly of FIGS. 1*a* and 1*b*.

If the user selects linear motion in step 104, then the controller may operate the actuators, 38 and 40, for imparting motion to the frame 12 in step 106. As illustrated in FIG. 3*a*, during operation of the actuators, 38 and 40, for imparting motion to the frame 12, the unbalanced weights, 54 and 58, are rotated by the motors, 46 and 48, respectively, about axes of rotation, 108*a* and 108*b*, respectively, in opposite directions, 108*c* and 108*d*, respectively, at substantially the same rotational speed with the rotational positions of the centers of mass, 108*e* and 108*f*, substantially mirror images of one another. The rotation of the unbalanced weights, 54 and 58, about the axes of rotation, 108*a* and 108*b*, produces centrifugal forces, 108*g* and 108*h*, respectively, that are directed from the centers of mass, 108*e* and 108*f*, respectively, of the unbalanced weights, 54 and 58, respectively, in the directions normal to the vectors from the centers of rotation to the corresponding centers of mass.

Figure 3B:
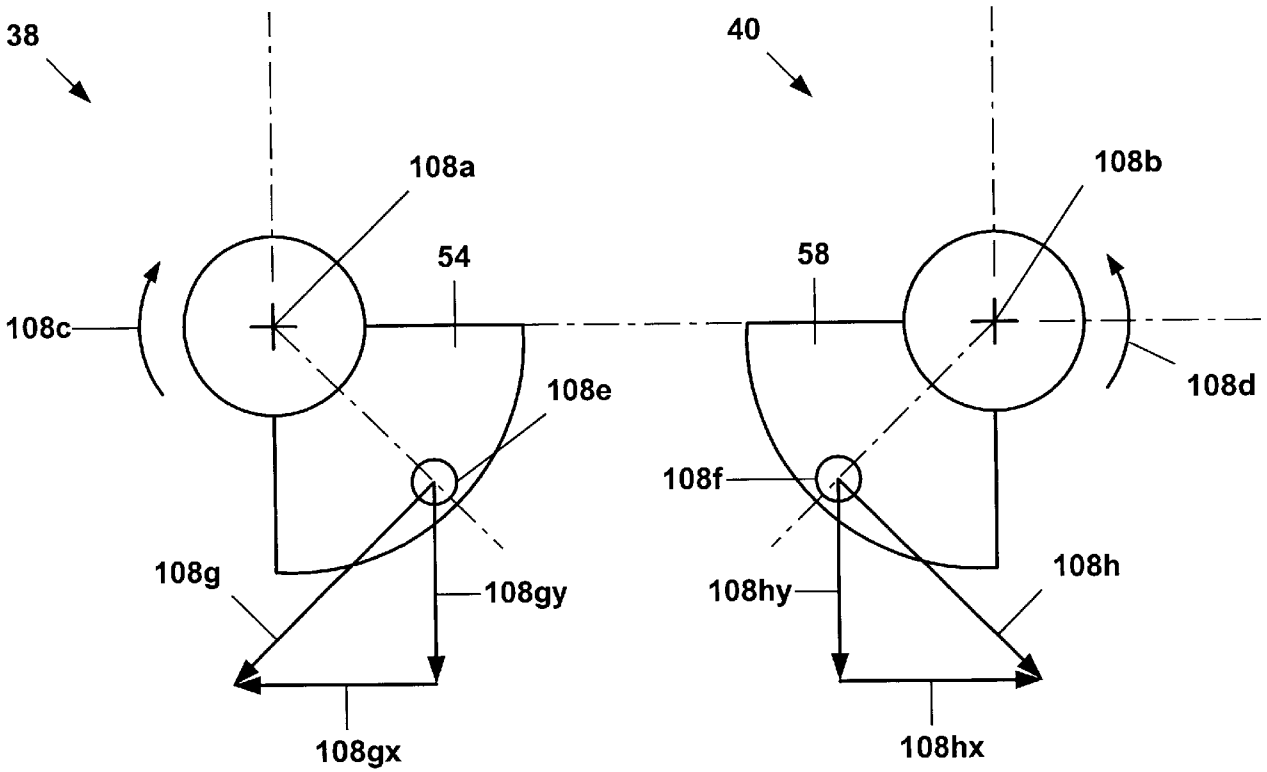
FIG. 3*b* is a schematic illustration of the forces imparted to the frame of the assembly of FIGS. 1*a* and 1*b* during the operation of the counter-rotating actuators.

The resulting centrifugal forces, 108*g* and 108*h*, created during the rotation of the rotation of the unbalanced weights, 54 and 58, about the axes of rotation, 108*a* and 108*b*, impart a reciprocal linear motion to the frame 12 of the assembly 10. In particular, as illustrated in FIG. 3*b*, the centrifugal forces, 108*g* and 108*h*, include horizontal components, 108*gx* and 108*hx*, respectively, and vertical components, 108*gy* and 108*hy*, respectively. Because, the direction and speed of rotation of the unbalanced weights, 54 and 58, are opposite and equal, the horizontal components, 108*gx* and 108*hx*, cancel each other out. As a result, the only forces acting on the frame 12 of the assembly due to the rotation of the unbalanced weights, 54 and 58, about the axes of rotation, 108*a* and 108*b*, are the sum of the vertical forces, 108*gy* and 108*hy*. Since the vertical forces, 108*gy* and 108*hy*, vary from a positive maximum vertical force to a negative maximum vertical force during the rotation of the unbalanced weights, 54 and 58, about the axes of rotation, 108*a* and 108*b*, the resulting linear motion imparted to the frame 12 of the assembly is a reciprocating linear motion. Thus, the combination of the actuators, 38 and 40, provides an actuator for imparting linear motion to the frame 12 of the assembly. In an exemplary embodiment, during operation, the rotational positions and centrifugal forces created during the rotation of the unbalanced weights, 54 and 56 and 58 and 60, about the axes of rotation, 108*a* and 108*b*, respectively, are substantially identical.

If the user selects elliptical motion in step 104, then the controller may simultaneously operate the actuator 26 for imparting motion to the frame 12 and the actuators, 38 and 40, for imparting motion to the frame in step 108.

Figure 4:
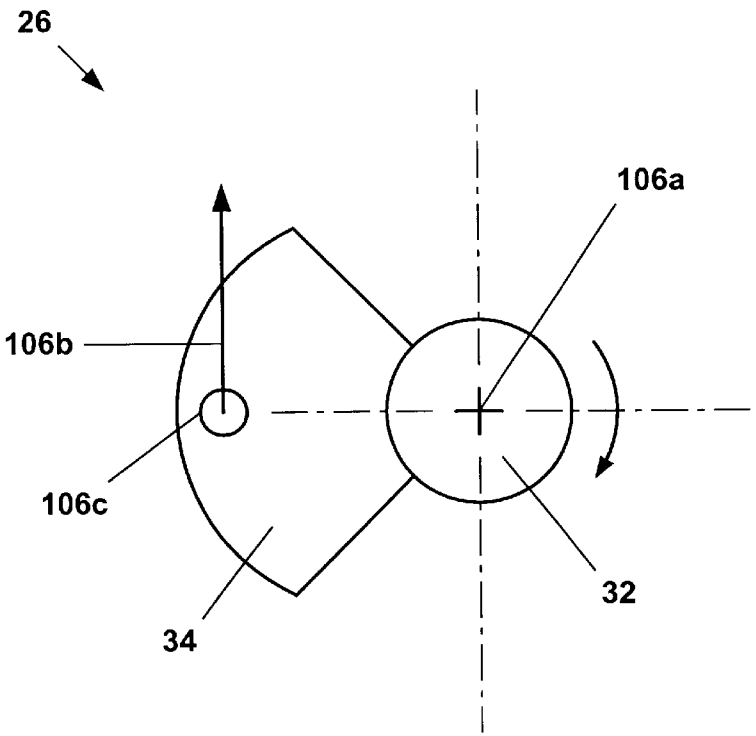
FIG. 4 is a side view of the operation of the additional rotating actuator of the assembly of FIGS. 1*a* and 1*b*.

As illustrated in FIG. 4, during operation of the actuator 26 for imparting motion to the frame 12, the unbalanced weight is rotated by the motor 30 about an axis of rotation 106*a*. The rotation of the unbalanced weight 34 about the axis of rotation 106*a* produces a centrifugal force 106*b* that is directed from the center of mass 106*c* of the unbalanced weight 34 in the direction normal to the vector from the center of rotation to the center of mass. In an exemplary embodiment, during step 108, the rotational positions, speeds, and centrifugal forces created during the rotation of the unbalanced weights, 34 and 36, about the axis of rotation 106*c* are substantially identical. The resulting centrifugal forces created during the rotation of the unbalanced weights, 34 and 36, about the axis of rotation 106*c* would impart a circular motion to the frame 12 of the assembly 10 if the actuator 26 were operated alone.

Because the rotary shaft 32 of the actuator 26 is perpendicular to a different plane than the rotary shafts, 50 and 52, of the actuators, 38 and 40, the simultaneous operation of the actuators, and the forces that are generated, as described above, results in elliptical motion being imparted to the frame 12 of the assembly 10. Thus, the combination of the actuators, 26, 38 and 40, provides an actuator for imparting elliptical motion to the frame 12.

If the user elects to discontinue the operation of the program 100 in step 110, then the operation of the program ends in step 112.

In an exemplary embodiment, during the operation of the assembly 10 using the motion control program 100, fluidic material including solid particles is injected onto the screen 64. In an exemplary embodiment, the injection of the fluidic material onto the screen 64 is provided substantially as described in U.S. patent application Ser. No. 09/836,974, filed on Apr. 18, 2001, the disclosure of which is incorporated herein by reference. In this manner, the separation of solid particles from the liquids within the fluidic material is enhanced by the motion imparted to the frame 12 and screen 64. In an exemplary embodiment, movement of the frame 12 and screen 64 along an elliptical path maintains solid particles on the screen for a longer period of time thereby permitting more liquids to be extracted from the fluidic material thereby providing a drier solid particle discard.

The present embodiments of the invention provide a number of advantages. For example, the ability to operate in a linear or an elliptical mode of operation without physical restructuring or mechanical reconfiguration of the assembly provides an efficient, reliable, and cost-effective system for providing both modes of operation.

It is understood that variations may be made in the foregoing without departing from the scope of the invention. For example, the actuators, 26, 38 and 40, for imparting motion to the frame 12 of the assembly 10 may include one or more unbalanced weights.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A separator for separating solids from liquids, comprising:

a frame;

a screen coupled to the frame; and means for moving the frame along first and second paths of travel comprising:

first and second counter-rotating means; and third rotating means;

wherein centers of rotation of the first and second counter-rotating means are normal to a common plane; and wherein a center of rotation of the third rotating means is not normal to the common plane.

2. The separator of claim 1, wherein, during the first path of travel, the first and second counter-rotating means rotate at substantially equal speeds.

3. The separator of claim 1, wherein the first counter-rotating means includes a first unbalanced weight; and wherein the second counter-rotating means includes a second unbalanced weight.

4. The separator of claim 3, wherein the mass and the locations of the centers of mass of the first and second unbalanced weights are substantially equal.

5. The separator of claim 1, wherein, during the second path of travel, the first and second counter-rotating means rotate at substantially equal speeds and the third rotating means rotates.

6. The separator of claim 1, wherein the first path of travel comprises a reciprocating linear path of travel; and wherein the second path of travel comprises an elliptical path of travel.

7. A method of operating a separator including a screen coupled to a frame, comprising:

injecting a fluidic material including solids and liquids onto the screen;

moving the frame along a reciprocating linear path of travel in a first mode of operation; and moving the frame along an elliptical path of travel in a second mode of operation;

wherein moving the frame along the elliptical path of travel comprises:

rotating a first unbalanced weight in a first direction about a first axis of rotation at a first speed;

rotating a second unbalanced weight in a second direction about a second axis of rotation at a second speed; and rotating a third unbalanced weight in a third direction about a third axis of rotation, wherein the first and second speeds are equal;

wherein the first and second directions are opposite; and wherein the first and second axes of rotation are normal to a different plane than the third axis of rotation.

8. The method of claim 7, wherein moving the frame along the reciprocating linear path of travel comprises:

rotating the first unbalanced weight in the first direction about the first axis of rotation at the first speed; and rotating the second unbalanced weight in the second direction about the second axis of rotation at the second speed.

9. The method of claim 8, wherein the mass and the locations of the centers of mass of the first and second unbalanced weights are substantially equal.

10. The method of claim 7, wherein the mass and the locations of the centers of mass of the first and second unbalanced weights are substantially equal.

11. A separator, comprising:

a frame;

a screen coupled to the frame;

an actuator for imparting reciprocating motion to the frame coupled to the frame;

an actuator for imparting elliptical motion to the frame coupled to the frame comprising:

a first actuator comprising:

a first rotary motor having a first output shaft; and a first unbalanced weight coupled to the first output shaft; and a second actuator comprising:

a second rotary motor having a second output shaft; and a second unbalanced weight coupled to the second output shaft; and a third actuator comprising:

a third rotary motor having a third output shaft; and a third unbalanced weight coupled to the third output shaft; and a controller operably coupled to the actuator for imparting reciprocating motion to the frame and the actuator for imparting elliptical motion to the frame for controlling the operation of the actuator for imparting reciprocating motion to the frame and the actuator for imparting elliptical motion to the frame;

wherein the controller is programmed to operate in a first mode of operation in which the actuator for imparting reciprocating motion is operated;

wherein the controller is programmed to operate in a second mode of operation in which the actuator for imparting elliptical motion to the frame is operated;

wherein the first and second output shafts are normal to a common plane; and wherein the third output shaft is not normal to the common plane.

12. The separator of claim 11, wherein the actuator for imparting reciprocating motion to the frame comprises:

the first actuator; and the second actuator.

13. The separator of claim 12, wherein, in the first mode of operation, the controller is programmed to rotate the first output shaft in a first direction at a first speed and rotate the second output shaft in a second direction at a second speed; wherein the first and second directions are opposite; and wherein the first and second speeds are substantially equal.

14. The separator of claim 12, wherein the position of the centers of mass and the mass of the first and second unbalanced weights are substantially equal.

15. The separator of claim 12, wherein the first and second output shafts are normal to a common plane.

16. The separator of claim 11, wherein, in the second mode of operation, the controller is programmed to rotate the first output shaft in a first direction at a first speed, rotate the second output shaft in a second direction at a second speed, and rotate the third output shaft; and wherein the first and second directions are opposite; and wherein the first and second speeds are substantially equal.

17. The separator of claim 11, wherein the position of the centers of mass and the mass of the first and second unbalanced weights are substantially equal.

18. A separator for separating liquids from solids, comprising:

a frame;

a screen coupled to the frame;

first and second counter-rotating means for moving the frame;

rotating means for moving the frame; and control means for operating the first and second counter-rotating means for moving the frame along a reciprocating linear path; and control means for operating the first and second counter-rotating means and the rotating means for moving the frame along an elliptical path;

wherein centers of rotation of the first and second counter-rotating means are normal to a common plane; and wherein a center of rotation of the rotating means is not normal to the common plane.

19. A method of operating a separator including a screen coupled to a frame, comprising:

injecting a fluidic material including solids and liquids onto the screen;

moving the frame along a reciprocating linear path of travel in a first mode of operation by a method comprising:

rotating a first unbalanced weight in a first direction about a first axis of rotation at a first speed; and rotating a second unbalanced weight in a second direction about a second axis of rotation at a second speed;

wherein the locations of the centers of mass and the masses of the first and second unbalanced weights are substantially equal; and wherein the first and second speeds are equal; and wherein the first and second directions are opposite; and moving the frame along an elliptical path in a second mode of operation by a method comprising:

rotating the first unbalanced weight in the first direction about the first axis of rotation at the first speed;

rotating the second unbalanced weight in the second direction about the second axis of rotation at the second speed; and rotating a third unbalanced weight about a third axis of rotation;

wherein the first and second axis of rotation are normal to a common plane; and wherein the third axis of rotation is not normal to the common plane.

20. A separator, comprising:

a frame;

a screen coupled to the frame;

a linear actuator coupled to the frame comprising:

a first rotary motor coupled to the frame comprising a first rotatable shaft;

a first unbalanced weight coupled to the first rotatable shaft;

a second rotary motor coupled to the frame comprising a second rotatable shaft; and a second unbalanced weight coupled to the second rotatable shaft;

wherein the location of the centers of mass and the mass of the first and second unbalanced weights are substantially equal; and wherein the first and second rotatable shafts are substantially parallel and are normal to the same plane;

an elliptical actuator coupled to the frame comprising:

the linear actuator;

a third rotary motor coupled to the frame comprising a third rotatable shaft; and a third unbalanced weight coupled to the third rotatable shaft;

wherein the third rotatable shaft is not normal to the same plane as the first and second rotatable shafts; and a controller operably coupled to the linear and elliptical actuators for controlling the operation of the linear and elliptical actuators;

wherein the controller is programmed to operate in a first mode of operation in which the first and second rotatable shafts are rotated at substantially the same speed in opposite directions; and wherein the controller is programmed to operate in a second mode of operation in which the first and second rotatable shafts are rotated at substantially the same speed in opposite directions while the third rotatable shaft is rotated.

* * * * *